US008936065B1

(12) United States Patent
Gillespie

(10) Patent No.: US 8,936,065 B1
(45) Date of Patent: Jan. 20, 2015

(54) REVERSE ACTION CORNER EMBEDMENT FOR STRETCHED CANVAS

(76) Inventor: James B. Gillespie, Centennial, CO (US)

( * ) Notice: Subject to any disclaimer, the term of this patent is extended or adjusted under 35 U.S.C. 154(b) by 0 days.

(21) Appl. No.: 12/966,939

(22) Filed: Dec. 13, 2010

Related U.S. Application Data

(60) Provisional application No. 61/291,331, filed on Dec. 30, 2009.

(51) Int. Cl.
*A47G 5/00* (2006.01)
*E06B 3/30* (2006.01)
*E06B 9/24* (2006.01)

(52) U.S. Cl.
USPC ..... 160/371; 160/374.1

(58) Field of Classification Search
USPC ..... 160/371, 381, 378, 374.1; 38/102.5, 38/102.4, 102.6, 102.7, 102.8, 102.9, 38/102.91; 403/205, 295, 382, 401, 402, 403/403
See application file for complete search history.

(56) References Cited

U.S. PATENT DOCUMENTS

| | | | | | |
|---|---|---|---|---|---|
| 367,672 | A | * | 8/1887 | Shattuck | 160/374.1 |
| 424,095 | A | * | 3/1890 | Cope | 160/374.1 |
| 424,096 | A | * | 3/1890 | Cope | 160/374.1 |
| 1,847,925 | A | | 3/1932 | Carter | |
| 1,916,022 | A | * | 6/1933 | Shull | 160/374.1 |
| 3,485,165 | A | | 12/1969 | Hughes | |
| 3,529,653 | A | | 9/1970 | Fey, Jr. | |
| 3,572,787 | A | * | 3/1971 | Timmerman et al. | 403/205 |
| 3,625,274 | A | * | 12/1971 | Johnson | 160/374.1 |
| 3,830,278 | A | * | 8/1974 | Packer | 160/378 |
| 3,882,616 | A | | 5/1975 | Starzyk | |
| 3,914,887 | A | * | 10/1975 | Newman | 38/102.8 |
| 3,949,802 | A | | 4/1976 | Buratovich | |
| 4,144,660 | A | | 3/1979 | Lamb | |
| 4,301,853 | A | | 11/1981 | Vidal | |
| 4,432,150 | A | * | 2/1984 | Swonger | 38/102.5 |
| 4,549,596 | A | | 10/1985 | Staro | |
| 4,635,700 | A | | 1/1987 | Berger | |
| 4,829,685 | A | | 5/1989 | Persson et al. | |
| 4,846,079 | A | * | 7/1989 | Ajax | 108/156 |
| 4,947,922 | A | | 8/1990 | Stobart | |
| 5,052,462 | A | | 10/1991 | Stobart | |
| 5,115,584 | A | | 5/1992 | Lucchetti | |
| 5,186,571 | A | * | 2/1993 | Hentzschel | 403/231 |
| 5,839,214 | A | * | 11/1998 | Peterson | 38/102.4 |
| 5,900,276 | A | | 5/1999 | Sooklaris | |
| 2002/0159832 | A1 | * | 10/2002 | Bowell | 403/403 |

(Continued)

OTHER PUBLICATIONS

Jack Richeson Company, Aluminum Pro-Bars by Best, www.richesonart.com, B.Best Corner Key Kit, No. 890048, Jack Richeson Company, Inc.

*Primary Examiner* — Katherine Mitchell
*Assistant Examiner* — Jeremy Ramsey
(74) *Attorney, Agent, or Firm* — Jeremy Cave

(57) ABSTRACT

A canvas tensioning frame corner having adjoining stretcher bar ends; each stretcher bar end having a tapered expanding groove from the inside of the corner to the tip of the corner; a corner embedment nested in the grooves; the corner embedment having tapered edges matching the grooves; wherein a movement of the corner embedment inward away from the tip of the corner urges the stretcher bars apart to stretch the canvas affixed to each stretcher bar, side and corner; a corner embedment brace attached across the corner to support a bolt attached to the corner embedment; and wherein a wing nut attached to the bolt urges the corner embedment toward the brace.

4 Claims, 8 Drawing Sheets

(56) References Cited

U.S. PATENT DOCUMENTS

2004/0101358 A1* 5/2004 Odorico et al. ..... 403/403
2006/0188325 A1* 8/2006 Dolan ..... 403/205
2010/0206497 A1* 8/2010 Ocampo ..... 160/374.1

* cited by examiner

C-C

D-D

REVERSE ACTION CORNER EMBEDMENT FOR STRETCHED CANVAS

CROSS REFERENCE APPLICATIONS

This application is a non-provisional application claiming the benefits of provisional application No. 61/291,331 filed Dec. 30, 2009.

FIELD OF INVENTION

The present invention relates to creating a tensioning device for an artist's stretched canvas which can be easily adjusted periodically to maintain proper tension over time at all four corners of the canvas stretcher frame without using tools.

BACKGROUND OF THE INVENTION

Since the Renaissance Period artists have used canvas stretched taut over a wood frame as their preferred surface for painting. Even then it was known that stretched canvas changes dimensionally with temperature and humidity change and must be re-stretched periodically to maintain proper tension on the painted canvas surface. If not maintained, slack and sag in the canvas over time will cause cracking in the paint surface and delamination of the paint from the canvas. This delamination is very detrimental to the preservation of these works of fine art. Restretching a painting on canvas initially required removing the numerous tacks which secured the canvas to the wood frame and then re-attaching the canvas again to the same or slightly smaller frame to achieve the proper surface tension. This is an elaborate process which often caused much damage to the edges of the canvas. Various methods subsequently have been developed to re-tension an art canvas without removing it from its stretcher frame. A brief description of this prior art follows below.

U.S. Pat. No. 1,847,925 discloses a frame with double interlocking tendon/mortise joints, wherein two 'keys' (small wedges) at each corner are tapped deeper into the mortice joints to separate the frame corner. These keys can loosen and fall out unless tacks are used to secure the wedged corner once the proper canvas tension is achieved. These tacks must then be removed to re-tension the canvas at a later date, again using tools and manipulations that endanger the artwork.

U.S. Pat. No. 3,485,165 discloses a silk screen frame with a traveling slide at each corner that stretches the silk using a bolt to pull the slide.

U.S. Pat. No. 3,529,653 discloses an expandable picture frame that uses a metal tensioning brace mounted diagonally across a corner. By adjusting a bolt that travels in a slotted opening, future adjustments can be made by loosening the bolt, and re-securing the brace, using a wrench.

U.S. Pat. No. 3,882,616 discloses a dual wedge frame tensioner but the wedges interlock. A hammer must be used to adjust the wedges.

U.S. Pat. No. 3,949,802 discloses a pair of metal brackets fastened at each corner of a standard mitered picture frame. Each bracket has an adjusting screw to push the frame corners apart. A screwdriver can be used for future re-tightening.

U.S. Pat. No. 4,144,660 discloses a picture frame corner that consists of a square block. Each frame arm projecting from the block can be tensioned by hand tightening a traveling nut mounted on a bolt imbedded into the corner block. No tools are needed to re-adjust the tension in the future.

U.S. Pat. No. 4,301,853 discloses a pair of metal corner brackets attached to a wooden frame. A threaded rod on each bracket is tightened by a wrench to adjust the tension in the corner. A spring biases the tension, thus spring fatigue could loosen the canvas.

U.S. Pat. No. 4,549,596 discloses a combination spring and screw adjuster to tension an insert in a hollow of a frame corner, thus spring fatigue could loosen the canvas.

U.S. Pat. No. 4,635,700 discloses a multi-spring two dimensional tensioning picture frame. Each spring can be adjusted for tension.

U.S. Pat. No. 4,829,685 discloses a rotatable cam at each corner of a tensioning frame. A screwdriver can adjust each corner's tension.

U.S. Pat. No. 4,947,922 discloses a coil spring imbedded in each corner to tension the canvas.

U.S. Pat. No. 5,052,462 discloses a frusto conical cone which spreads two disks apart with a screwdriver.

U.S. Pat. No. 5,115,584 discloses a frame stretcher which uses a series of insertable rods to stretch the frame.

U.S. Pat. No. 5,900,276 discloses the use of a water based adhesive to re-tighten a canvas.

U.S. Pat. No. 6,347,466 discloses a thermoplastic heat shrinking canvas method.

What is needed in the art is a simple stretcher frame without springs that can open (expand) the corners of the frame merely by twisting a wing nut or knob. The present invention integrates a reverse action corner embedment at each corner joint to accomplish these objectives.

SUMMARY OF THE INVENTION

The main aspect of this invention is an embedment at each corner of a wood stretcher frame which serves to align and hold the corner together and has a wedge-shaped feature which, when activated by drawing the embedment inward, will expand the corner joint and evenly tension the canvas surface attached to the back of the frame and stretched across the front face of the frame. The embedment is symmetrically disposed across the mitered corner joint of the wood stretcher frame with a blade-shaped component that is contained within a slot cut through and perpendicular to the miter cut at each end of the two adjoining frame members (stretcher bars), which mate to form a frame corner. The depth of each matching slot is greater at the outside edge of the frame corner and tapers inward to a lesser depth at the inside corner of the frame to thereby match the size and wedge-shaped aspect of the embedment. The embedment is formed plastic with a base (hilt) of greater thickness which extends beyond the inside corner of the frame. This hilt is triangular in shape and mates with the right angle of the inside corner. The embedment thus serves to aid alignment and assembly of the stretcher frame corner. The exposed hilt-shaped extension of the embedment provides the means for attaching a bolt which passes through a brace mounted across the inside corner of the frame. The wedge-shaped embedment is retracted (drawn inward) by means of a winged nut attached to end of the bolt. Through this action the frame corner is gradually expanded (opened) thereby stretching or tensioning the artist canvas attached to the stretcher frame. Another aspect of the invention is provided by the metal corner brace that crosses the inside corner of the frame and supports the action of the bolt and winged nut in expanding the corner to tension the canvas. This brace is a "u" shaped channel with parallel sides triangular in shape (right triangles) that extend inward from the base and fit to and support the inside corner of the frame. Centered in the base of the channel is a hole through which the shaft of the embedment-attached bolt is passed and thereafter a winged nut is attached to the bolt end. The brace is directly attached to the frame members by means of screws through ears that extend outward on either side of the brace. Slots in each ear allow for the brace to be tightly fixed to the stretcher frame. When tensioning adjustments are made to the frame these screws are loosened slightly in the slots and the brace becomes slidingly engaged to thereby support the wedging action of the embedment and to retain its connection and contact with the inside corner of the stretcher frame, thus providing continual structural support for the frame corner of the frame during tensioning adjustment. The present invention provides alignment and structural support for the wood stretcher frame while operating as a unique and effective corner expansion device, providing an easy-to-use and highly controlled means for assembling, stretching, adjusting and maintaining the proper the surface tension for artist canvas.

Other aspects of this invention will appear from the following description and appended claims, reference being made to the accompanying drawings forming a part of this specification wherein like reference characters designate corresponding parts in the several views.

In practice the rectangular wooden stretcher frame is made of four wood bars with their ends mitered to form the right-angle aspect of each corner. A matching groove is cut in each adjoining bar to form a single slot with an expanding angle from the inside out at each corner joint. Placed in the corner slot of these adjoining frame ends is a one piece (molded plastic) wedge. A metal brace is affixed across the inside corner formed by the adjoined frame members. A pull-bolt is connected to the wedge and threaded through a hole in the brace. A wing nut attached to the end of the pull-bolt uses the metal brace to gradually draw the wedge inward, thereby spreading the frame members apart. Applied to each of the four corners of the frame, the expansion thus achieved results in an even, controlled retensioning of the canvas which is attached to the wood frame.

In years to come the frame may be re-tightened and canvas retensioned quickly and easily by slightly twisting the wing nut at each corner whenever such retensioning is required.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1A:
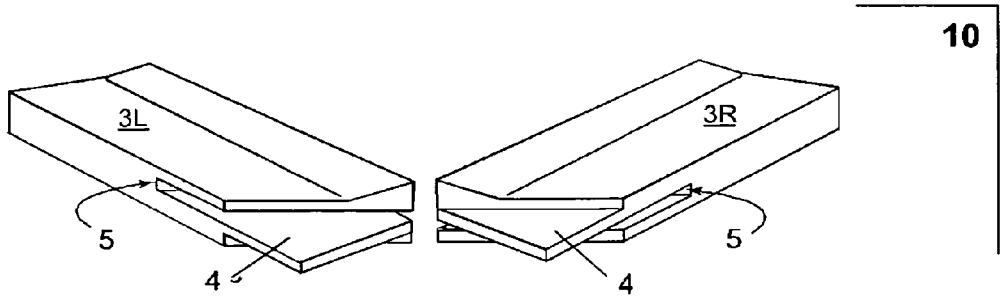
Fig. 1a Prior Art
FIG. 1*a* (prior art) is a perspective view of the matching mortise & tendon corner cut of traditional wooden frame stretcher bars.
Figure 1B:
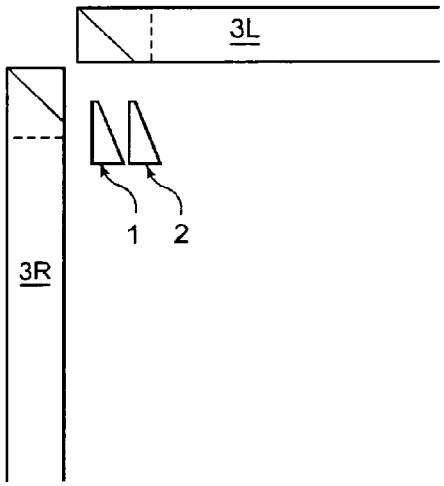
Fig. 1b Prior Art
FIG. 1*b* (prior art) is a plan view of the components for one corner using the traditional stretcher bars (FIG. 1*a*) and two small wedges (keys).
Figure 1C:
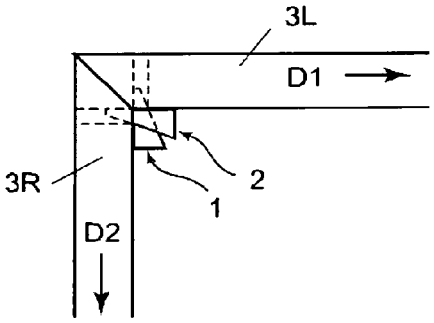
Fig. 1 c Prior Art
FIG. 1*c* (prior art) is a plan view of the assembled components shown in FIG. 1*b*.

The prior art dual key frame 10 of FIGS. 1*a*-1*c* does require a hammer to knock the keys (small wedges) 1, 2 into groove(s) 5 of paired frame element 3L and 3R that combine to form one corner joint of a stretcher frame. The tongue 4 of each frame member 3L and 3R fits within a matching groove 5 of its paired corner frame member as shown in FIG. 1*a*. Forcing key 1 into groove 5 as shown in FIG. 1*c* separates frame member 3L from 3R in direction D1. Wedge 2 separates the frame member 3R from 3L in direction D2. Skilled craftsmen must use a hammer to properly tension the stretched canvas (not shown) using this means at each corner of the stretcher frame.

Figure 2A:
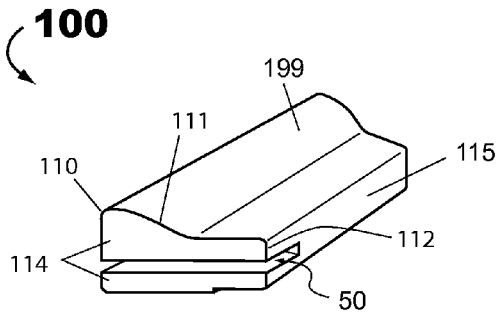
FIG. 2*a* is a perspective view of the preferred embodiment showing the typical miter cut and groove at the end of the wooden frame stretcher bars.
Figure 2B:
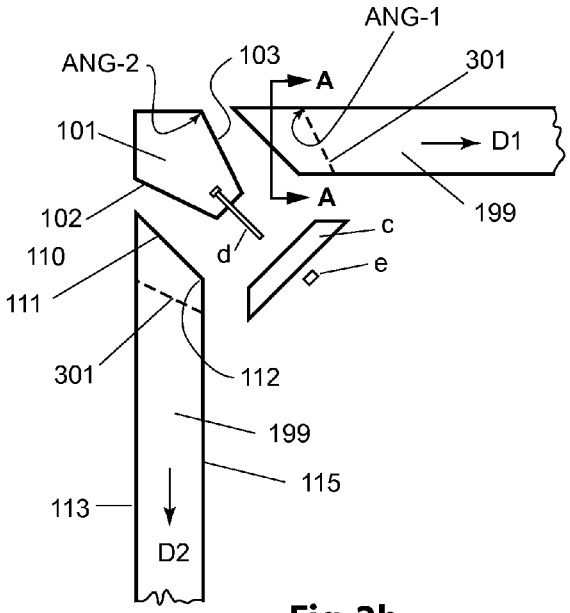
FIG. 2*b* is an exploded view of the first embodiment of the present invention.
Figure 2C:
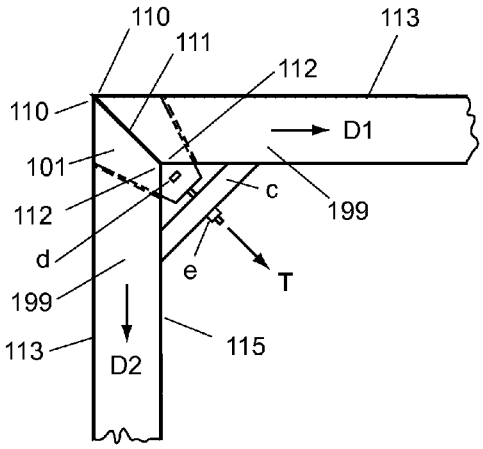
FIG. 2*c* is a plan view of the FIG. 2*b* embodiment when assembled.
Figure 2D:
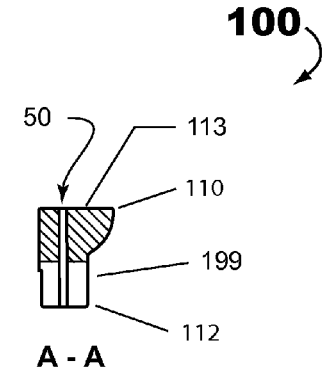
FIG. 2*d* is a section view taken along line A-A of FIG. 2*b*.

Frame 100 in FIGS. 2*a*-26 uses a single corner embedment 101 resting in groove(s) 50 of each frame member 199. As the corner embedment 101 is urged in direction T for tension, the outer faces 102, 103, force the inner edge facing 301 of grooves 50 away from each other equally in directions D1, D2, thus tensioning the stretched canvas (not shown) attached to the frame members. The corner embedment 101 is drawn in direction T by means of a bolt with head end affixed to the corner embedment and threaded end passing through a hole in brace c and thereafter connected with nut e. Bolt d with attached corner embedment 101 are drawn in direction T as nut e is turned to establish leverage against corner embedment brace c. The nut e can be a wing nut or threaded knob since hand pressure alone is adequate to achieve the tensioning movement desired. Angle ANG-1 of the groove 50 matches the obtuse angle ANG-2 of corner embedment 101 as is clearly seen in FIG. 2*c*. FIG. 2*c* shows frame 100 before any tensioning on nut e to separate the frame members 199 away from each other. Corner embedment brace c could be a simple wooden cross member that engages and slides against the inside face 115 of each frame member. Each frame member 199 ends with an outer corner tip 110, a corner joint edge 111 and an inner corner tip 112. The corner embedment 101 is mostly encased and hidden within the frame member grooves 50. The stretcher frame outside border is designated 113. The stretcher frame corner joint face is designated 114.

Figures 3A, 3B, 3C:
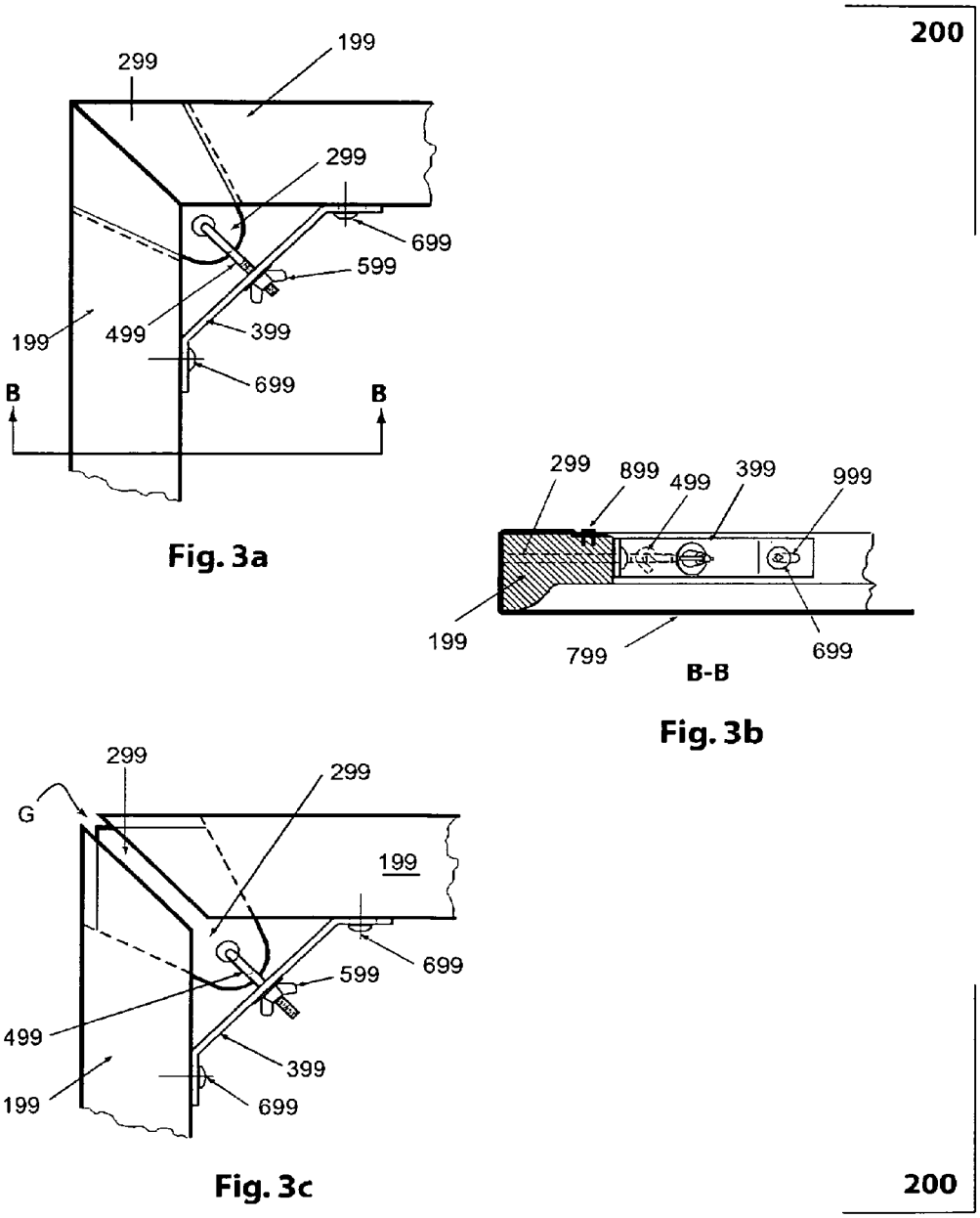
FIG. 3*a* is a plan view of a second embodiment of the present invention.
FIG. 3*b* is a section view taken along line B-B of FIG. 3*a*.
FIG. 3*c* is a plain view as in FIG. 3*a* with the stretcher frame corner embedment adjusted to its maximum corner expansion.

Referring next to FIGS. 3*a*-3*c* a tensioning frame 200 consists of wood stretcher bars (frame members) 199, each having an angled groove to receive the corner embedment 299. The corner embedment brace 399 straddles the stretcher bars 199 and is fastened thereto with tap screws 699. A slot 999 allows for adjustment of the corner embedment brace 399 in response to the tensioning movement of bar 199. The hook bolt 499 hooks into the corner embedment 299 and travels thru corner embedment brace 399 to be pulled inward by wing nut 599. The canvas 799 (FIG. 3*b*) is attached to the stretcher bars 199 with staples 899. FIG. 3*c* shows the wing nut 599 turned to about the maximum tension thereby spreading the stretcher bars 199 apart forming gap G.

Figure 4A:
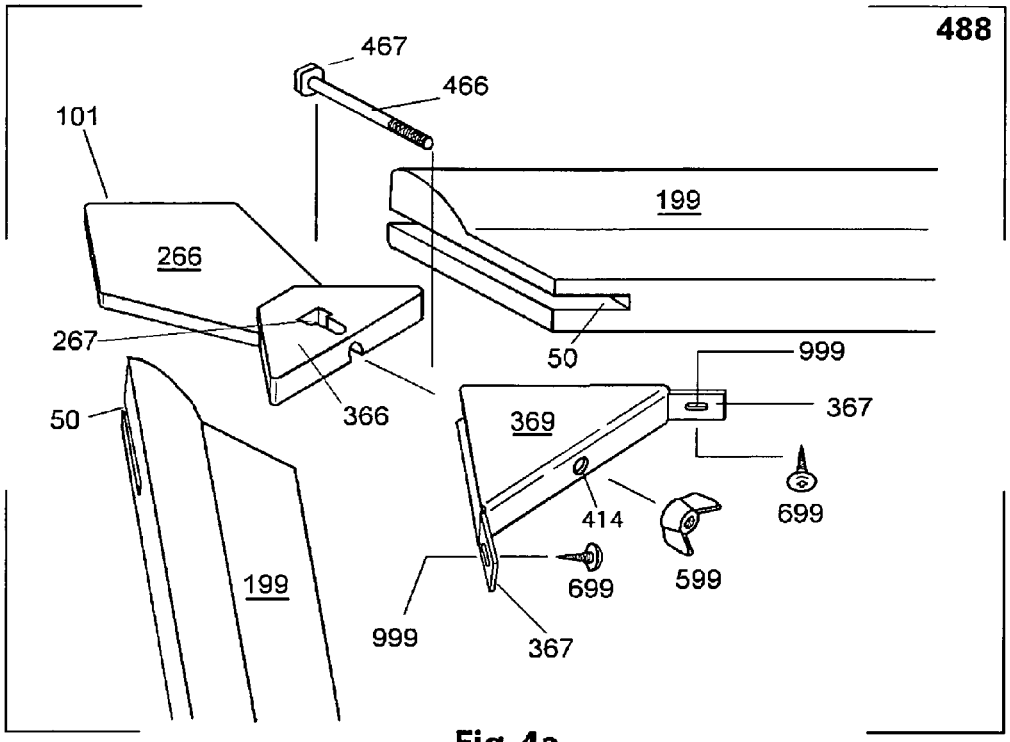
FIG. 4*a* is an exploded view of a third embodiment of the present invention.
Figure 4B:
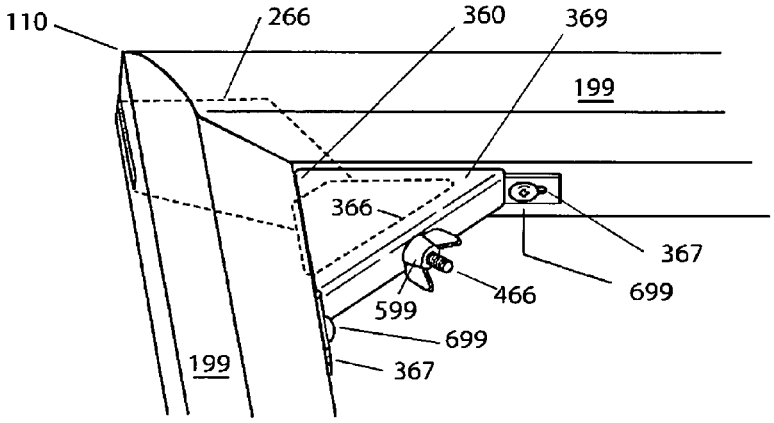
FIG. 4*b* is a perspective view of the assembled FIG. 4*a* embodiment.

FIGS. 4*a*, 4*b* refer to tensioning frame 488 in the preferred embodiment of the invention. FIG. 4*a* is an exploded view revealing the individual components of frame 488 including: The (wooden) stretcher bars 199 appropriately contoured with outer edge of greater thickness to support the attachment and tensioning of the canvas across the outside front edge of frame 488 extending through corner point 110 of the frame as shown in FIG. 4*b*. The end of each bar 199 is cut at an inward sloping angle to form a mitered corner joint when mated to form the frame corner. Each bar 199 containing a slot 50 through its mitered end which matches the edge thickness and angled form of the wedge-shaped, blade-like component 266 of embedment 101. Embedment 101 includes a hilt 366 which is greater in thickness than the wedge-shaped blade component 266 and shaped to mate with the inside corner of the frame. A friction-fit right angled corner joint is formed when the embedment blade 266 is pressed into the slots 50 in bars 199 with its angled (90 degree) outer face aligned with the outside edges of bars 199, the embedment hilt 366 is matched to the inside corner formed by the adjoined bars and the mitered ends of the bars 199 abut to form a single seam as in FIG. 4*b*. The exposed hilt 366 of embedment 101 contains a molded cavity 267 to accept bolt 466 which is slipped through the cavity of the hilt 366 and locked in place by means of bolt head 467 with the bolt shaft extending away from the hilt 366. A U-shaped metal corner brace 369 with parallel triangular-shaped faces to support the inside corner is slipped over the exposed hilt 366 as threaded bolt 466 passes through a hole 414 centered in the base of the brace 369. A winged nut 599 is thereby attached to the threaded end of bolt 466. The U-shaped metal brace 369 features ears 367 extending outward in line with bars 199 and contain slots 999 through which screws 699 attach the brace to the corner framing members (bars) 199. The finished assembly is shown in FIG. 4*b*. To action the canvas stretching feature of frame 488 the screws 699 are first loosened slightly to allow U-shaped brace 369 sliding engagement in support of the corner expansion while maintaining tight contact (bracing integrity) with the inside corner of the frame. Winged nut 599 is turned to draw embedment 101 inward thereby initiating a controlled wedging action of 266 across the interior of the bars 199 along the inside angular edge of slots 50.

Canvas (not shown) attached to the back of the stretcher frame 488 and suspended across the front edge of the frame will tighten as the corners of tensioning frame 488 are expanded.

Figure 5B:
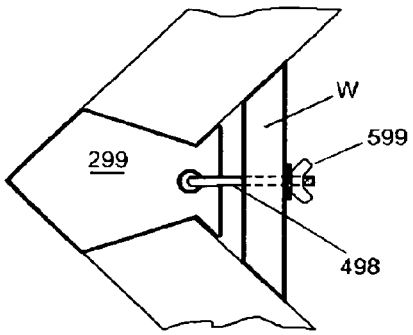
FIG. 5*b* is the plan view of the embodiment shown in FIG. 5*a*.
Figure 5A:
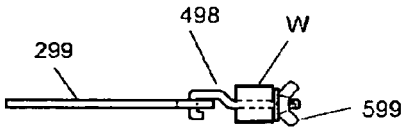
FIG. 5*a* is a side view of a solid (wood) brace and bolt hook embodiment.

In FIGS. 5*a*, 5*b* a version of Frame 200, FIG. 3*a*-3*c* shows a re-configured bolt hook 498 and a thick (wooden) brace W with corner embedment 299 reshaped for interface with the square inside corner of the stretcher frame and the solid (wood) brace W components.

Figure 5C:
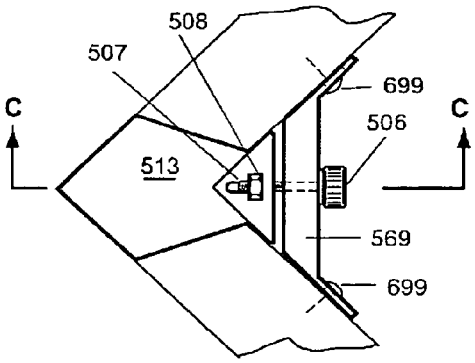
FIG. 5*c* is a plan view of a nut & knob-bolt embodiment.
Figure 5D:
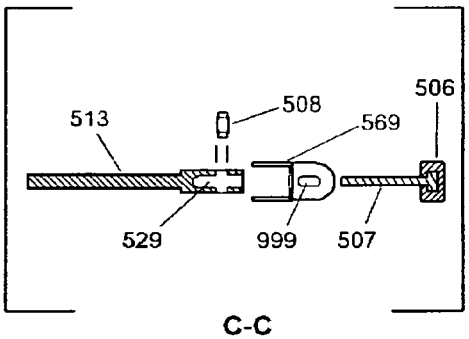
FIG. 5*d* is an exploded section view along line C-C of the knob-bolt embodiment of FIG. 5*c*.

In FIGS. 5*c*, 5*d* a wedge 513 has a retaining hole 529 to receive nut 508 which allows the bolt 507 to travel therethrough for tensioning. A knob 506 is affixed to the bolt by embedment casting thus allowing the bolt 507 to be turned by hand. The brace 569 can overlap the end of wedge 513 for added travel and support as FIG. 4*b*.

Figure 5E:
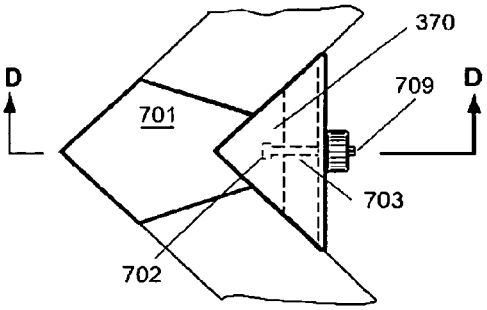
FIG. 5*e* is a top plan view of an imbedded bolt & triangular u-brace embodiment.
Figure 5F:
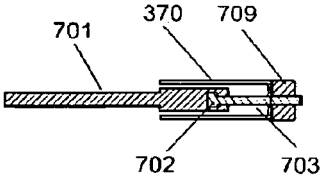
FIG. 5*f* is a section view along line D-D of the FIG. 5*e* embodiment.
Figure 6A:
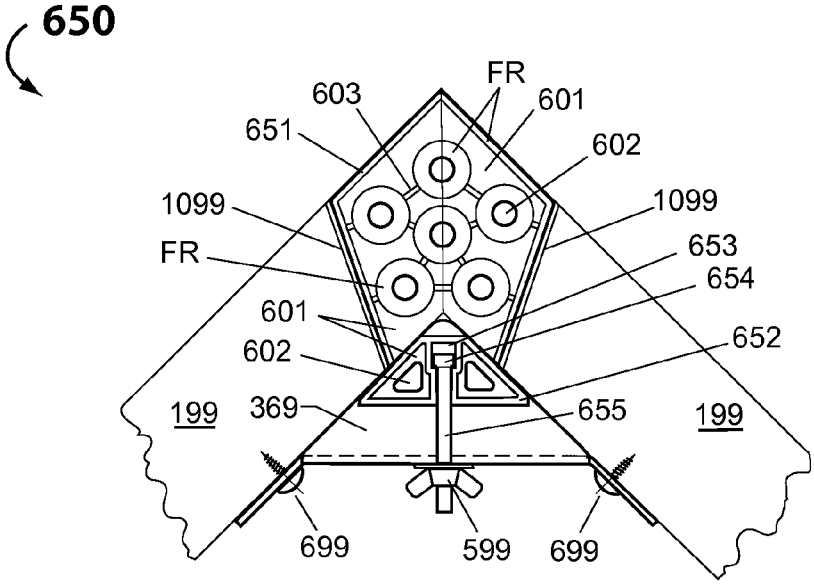
FIG. 6*a* is a phantom shell plan view of a fourth embodiment of the present invention.
Figure 6B:
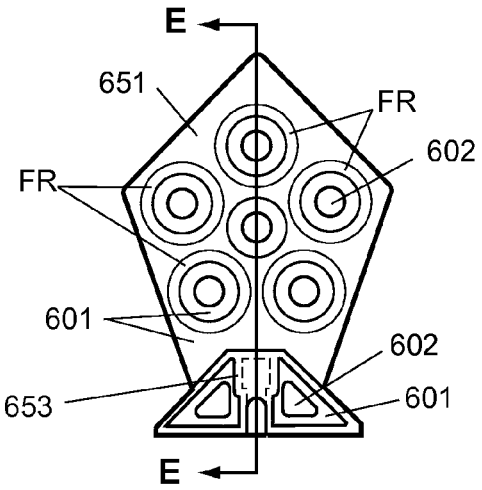
FIG. 6*b* is a plan view (obverse side) of the formed plastic wedge from the assembly in FIG. 6*a*.
Figure 6C:
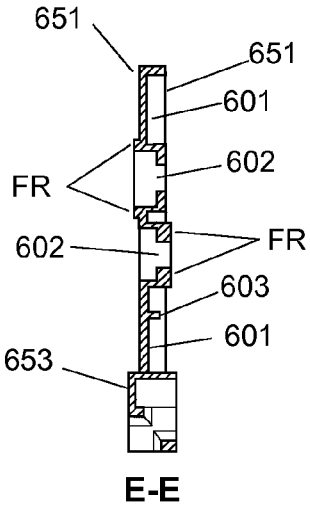
FIG. 6*c* is cross-section view (taken along E-E) of the wedge from FIG. 6*b*.
Figure 6D:
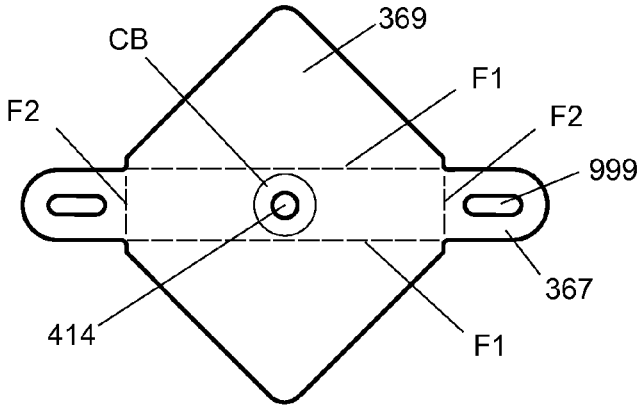
FIG. 6*d* is a plan view of a metal stamping ready to be formed into the wedge brace of FIG. 6*a*.
Figure 6E:
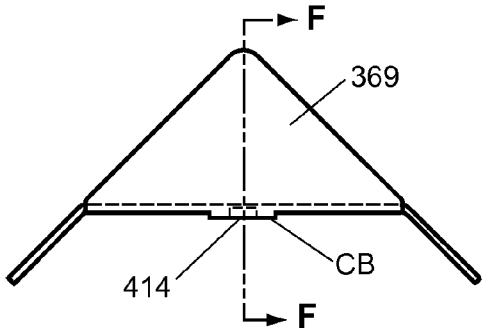
FIG. 6*e* is a top plan view of the wedge brace of FIG. 6*a*.
Figure 6F:
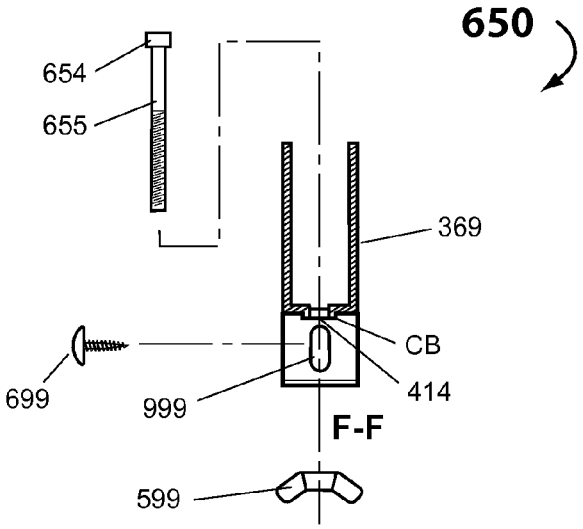
FIG. 6*f* is an exploded view of the separate fasteners (bolt, wing nut, screw) with section view (F-F from FIG. 6*e*) of the wedge brace assembly shown in FIG. 6*a*.

In FIGS. 5*e*, 5*f* the plastic wedge 701 is fastened by embedment casting to head 702 of bolt 703. The knob 709 is threaded through to pull the bolt 703 therethrough for tensioning.

Referring next to FIGS. 6*a*-6*f* a tensioning frame 650 consists of stretcher bars 199 each with grooves 1099. The wedge 651 is one piece molded plastic with weight and material saving recesses 601 and holes 602. Ribs 603 provide rigidity and strength. Raised area 653 is contoured to receive and lock in bolt head 654 as a snap-in-place fitting. Bolt 655 is tensioned by wing nut 599 via brace 369. Brace 369 is built from sheet metal (FIGS. 6*d*, 6*e*) with fold lines F1 at 90° and fold lines at F2 at 45°. Coined boss CB supports hole 414. Brace 369 with screw attachments 699 through slots 999 provides structural reinforcement as well as tensioning adjustment as in FIG. 4*b* tensioning frame 488. Friction ridges FR of wedge 651 contact the inner surfaces of the grooves 1099 in the stretcher bars 199 so as to reduce the sliding friction as compared to a flat surfaced wedge as shown in FIG. 4*a* tensioning frame 488.

Figure 7A:
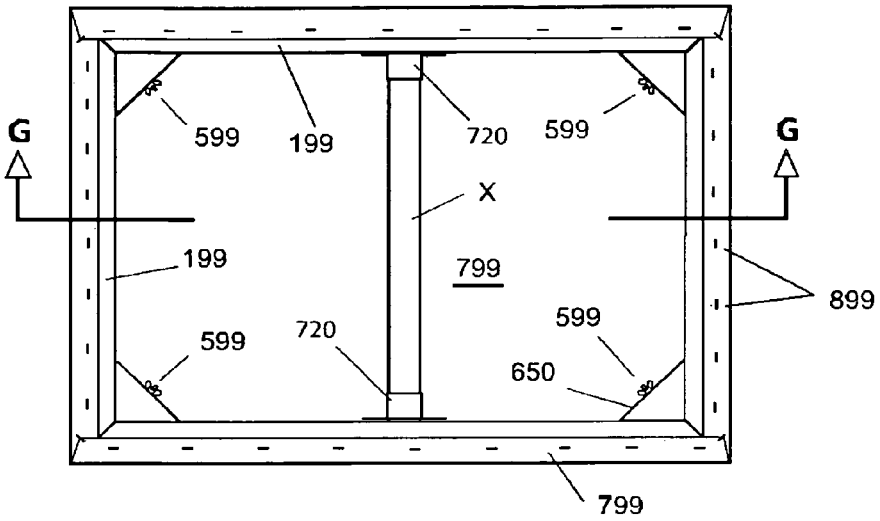
FIG. 7*a* is a plan view of the entire back side of an assembled canvas and stretcher frame using the embodiment of the invention shown in FIG. 6*a*.
Figure 7B:
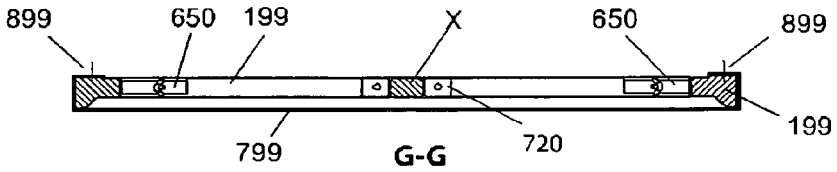
FIG. 7*b* is a sectional view taken along line G-G of FIG. 7*a*.
Figure 8A:
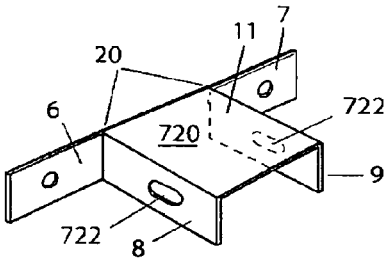
FIG. 8*a* is a perspective view of a cross brace bracket indicated in FIG. 7*a*
Figure 8B:
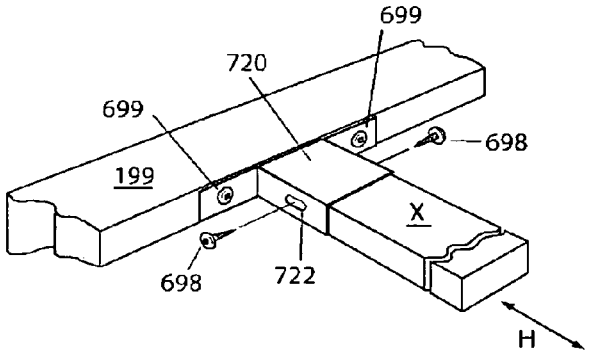
FIG. 8*b* is an assembly view of the brace bracket shown in FIG. 7*b*.

In FIGS. 7*a*, 7*b* the art canvas with stretcher frame is shown in full back plan view FIG. 7*a* and section view FIG. 7*b* with the current invention of the canvas retensioning device 650 shown installed at all four corners. Staples 899 secure the canvas 799 to wooden stretcher bars 1099. Merely turning wing nuts 599 tensions the canvas 799. For large size stretched canvases cross bracing is regularly added to the stretcher frame to support long spans and maintain the structural integrity of the stretcher bar frame. FIG. 7*a* shows cross brace X thus added at midpoint of the horizontal span and attached to the stretcher frame via brace brackets 720. FIGS. 8*a*, 8*b* show the u-shaped brace bracket 701 with sides 8, 9 at right angle to bracket face 11. A bracket 720 is fitted over each end of brace X and attached by screws 698 through slots 722 on bracket faces 8, 9. Bracket ears 6, 7 extend outward at right angles to bracket faces 8, 9 respectively. Ears 6, 7 constitute a flange for attachment to the stretcher frame members 199 with screws 699 through ear holes 721. Stretcher frame tensioning via device 650 will cause expansion along axis H of the brace. This expansion is accounted for within brace bracket 698 by first loosening bracket screws 698 in slots 722 to allow brace X to travel inside the affixed brackets along axis H. Screws 698 are then re-tightened when the tensioning process is completed. Brace bracket 720 thus accommodates periodic canvas tensioning adjustment (facilitated by operating device 650 FIG. 7*a*) while providing brace joint strength and rigidity for large stretched canvas frames that require effective bracing to prevent frame deflection, warping and distortion.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A frame corner retensioning structure for providing an adjustable tension across a canvas sheet stretched upon a frame having a frame corner retensioning structure at each of its corners, said frame corner retensioning structure comprising:

(a) a first and second frame member;

(b) each of said first and second frame members having an outer corner tip tapering inward to an inner corner tip to form an acute angle frame corner between a frame outside border and a frame corner edge;

(c) each of said frame corner edges having a mitered groove running parallel to the frame corner edge forming a first frame member mitered groove and a second frame member mitered groove;

(d) a formed plastic corner embedment, frictionally engaged between the first and second frame member mitered grooves, said embedment with a hilt base extending beyond an inside corner of the frame;

(e) a U-shaped corner brace with parallel triangular-shaped faces fitting on the inside corner formed by the joining of the first and second frame member, said U-shaped corner brace with ears extending outward with the first and second frame members and attached to the first and second frame members via screws, and said U-shaped corner brace accepting the hilt of the said corner embedment;

(f) a fastener anchored to the corner embedment, said fastener having a threaded end projecting through the U-shaped brace located across the first and second frame members; and (g) a nut means screwed onto the threaded end functioning to draw the corner embedment inward when tightened so as to spread the first and second frame members apart.

2. The apparatus of claim 1, wherein the nut means further comprises a wing nut.

3. The apparatus of claim 1, wherein the formed plastic corner embedment further comprises a base (hilt) having a slot which supports a head of the fastener to form an anchor.

4. The apparatus of claim 3, wherein the formed plastic corner embedment further comprises a plurality of friction ridges rising above a plurality of material saving recesses, said friction ridges providing a lower coefficient of drag against a sliding action of the corner embedment.

* * * * *